US005267729A

United States Patent [19]

Hirota et al.

[11] Patent Number: 5,267,729

[45] Date of Patent: Dec. 7, 1993

[54] SORTER HAVING A BELT GUIDE WITH A CUSHION MEMBER

[75] Inventors: Fumiyuki Hirota, Tachikawa; Izumi Hamanaka, Hachioji, both of Japan

[73] Assignee: Konica Corporation, Tokyo, Japan

[21] Appl. No.: 750,419

[22] Filed: Aug. 27, 1991

[30] Foreign Application Priority Data

Aug. 31, 1990 [JP] Japan ..... 2-92159[U]
Aug. 31, 1990 [JP] Japan ..... 2-92160[U]

[51] Int. Cl.[5] ..... B65H 39/10

[52] U.S. Cl. ..... 271/297; 271/198; 271/274; 271/303

[58] Field of Search ..... 271/198, 272, 274, 275, 271/287, 296, 297, 305, 314, 303; 198/604, 607, 841

[56] References Cited

U.S. PATENT DOCUMENTS

| | | | |
|---|---|---|---|
| 2,899,201 | 8/1959 | Pirot | 271/272 |
| 4,026,540 | 5/1977 | Lawrence | 271/287 |
| 4,116,429 | 9/1978 | VanBuskirk et al. | 271/287 |
| 4,190,185 | 2/1980 | Thate | 271/274 X |
| 4,482,148 | 11/1984 | Stewart, Jr. | 271/274 X |
| 4,555,106 | 11/1985 | Ruenzi | 271/274 X |
| 4,776,580 | 10/1988 | Honma | 271/296 |

FOREIGN PATENT DOCUMENTS

| | | | |
|---|---|---|---|
| 385652 | 9/1990 | European Pat. Off. | 271/272 |
| 1921261 | 11/1970 | Fed. Rep. of Germany | 271/198 |
| 33039 | 2/1990 | Japan | 271/272 |
| 117537 | 5/1990 | Japan | 271/274 |

*Primary Examiner*—Robert P. Olszewski
*Assistant Examiner*—Boris Milef
*Attorney, Agent, or Firm*—Finnegan, Henderson, Farabow, Garrett & Dunner

[57] ABSTRACT

A sorter for sorting recording sheets after image recording by an image forming apparatus is disclosed here. The sorter is provided with a plurality of bins arrayed along a main path of the recording sheet, a plurality of change over gates to guide the recording sheet from the main path to a selected bin, a conveyance mechanism to convey the recording sheet through the main path to the selected bin, a plurality of pinch rollers dispersively located near the gates and the bins to press the recording sheet onto a conveyance surface of a conveyor belt of the conveyance mechanism and a member to back up the conveyor belt from the pressure of the pinch rollers.

3 Claims, 5 Drawing Sheets

PRIOR ART

SORTER HAVING A BELT GUIDE WITH A CUSHION MEMBER

BACKGROUND OF THE INVENTION

The present invention relates to a conveyance means provided in a sorter which is combined with an image forming apparatus so as to sort recording sheets discharged from the apparatus.

In general, as shown in FIG. 2, a sorter is combined with an image forming apparatus 1 and functions as follows: recording sheets 5 discharged from the image forming apparatus 1 are conveyed by a conveyance means provided in a conveyance section 18 in the aforementioned sorter 10 and sorted by a changeover gate so that the sorted recording sheets 5 can be sequentially put into numerous bins 20 which are provided in the sorter 10.

As illustrated in FIG. 3, the conveyance section of the aforementioned sorter 10 conveys the aforementioned recording sheets 5 to the first bin 20*a* through a changeover gate 21*a*. The recording sheets 5 are conveyed and sorted into bins 20 including the first bin 20*a* installed in the sorter 10 by the first and second belt conveyance mechanisms 18, 19 through changeover gates 21 and the aforementioned changeover gate 21*a*.

As illustrated in the drawing, the aforementioned first belt conveyance mechanism 18 is composed of an upper roller 12 and a lower roller 13 which are vertically arranged being rotatably supported by side plates of the sorter 10, and an endless conveyance belt 14 is wound around the upper and lower rollers 12, 13.

The aforementioned lower roller 13 is driven by a drive unit 25 provided in the aforementioned sorter 10 so that the aforementioned conveyance belt 14 can be vertically rotated. The second belt conveyance mechanism 19 is installed above the first belt conveyance mechanism 18. In a non-sorting operation, all of the aforementioned recording sheets are conveyed to the aforementioned first bin 20*a* through the changeover gate 21*a*. Usually, the conveyance means, changeover gate and bins are used both in a non-sorting operation and a sorting operation. Consequently, in a sorting operation, recording sheets 5 are conveyed to a predetermined bin by changing over the changeover gate 21*a* and gates 21, wherein the changeover gate 21*a* is utilized not only for sorting recording sheets to be put into the first bin 20*a* but also for sorting recording sheets to be put into other bins 20, and wherein the gate 21 is exclusively used for sorting recording papers to be put into the corresponding bin.

The second belt conveyance mechanism 19 which is also utilized in a non-sorting operation, is composed in such a manner that: a roller 12*a* which is pushed by a spring against the circumferential surface of the upper conveyance roller 12 of the aforementioned first belt conveyance mechanism 18, and a roller 26 which is disposed on the left of the roller 12*a*, are rotatably supported by side plates of the aforementioned sorter 10; and an endless flat belt 27 is wound around the rollers 26 and 12*a*. A pinch roller 28 is installed below the aforementioned roller 26, and pressed against the roller 26 through the conveyance belt 27, so that the torque of the roller 26 can be transmitted to the pinch roller 28.

The second belt conveyance mechanism 19 is driven in such a manner that: an exclusive drive unit 29 drives the aforementioned drive roller 26; and the torque of the drive roller 26 is transmitted to the aforementioned rollers 12*a* and 28.

The recording sheet 5 which has been conveyed into the aforementioned sorter 10 by the aforementioned upper roller 12 and roller 12*a*, passes through a passage 16*a* formed by the aforementioned changeover gate 21*a* provided between the upper roller 12 and the drive roller 26, and the lower surface of the aforementioned belt 27, and then the recording sheet 5 is pinched between the aforementioned roller 26 and the pinch roller 28 through the flat belt 27 so as to be successively conveyed into the aforementioned bin 20*a*.

As explained above, in a conventional sorter, the second belt conveyance mechanism, which is also used in the case of a non-sorting operation, is used so as to positively convey recording sheets to the first bin.

As explained above, the above-described paper discharging rollers are driven by an exclusive drive unit or other drive units, and torque is transmitted to idle rollers from the driven paper discharging rollers, so that the mechanism is very complicated and the cost is increased.

The first object of the present invention is to provide a sorter having a simple and low-cost conveyance means in which the aforementioned problems can be solved.

As described above, the first belt conveyance mechanism 18 of the conventional sorter is provided with numerous guide rollers 15*a*, so that the conveyance mechanism is complicated and the cost is increased, and further a loud noise is made when the sorter is operated. The second object of the present invention is to solve the aforementioned problems and to provide a simple and low-cost sorter having guides for a conveyance belt, in which recording sheets can be stably conveyed without making a loud noise.

SUMMARY OF THE INVENTION

The sorter comprises a plurality of bins, changeover gates used to change over recording sheets to the bins, and a conveyance means to convey recording papers. The aforementioned conveyance means is provided with the first and second belt conveyance mechanism which include an endless conveyance belt and at least a pair of rollers, and provided with a plurality of pinch rollers, wherein most of the pinch rollers are located close to the aforementioned bins and changeover gates, and pressed against the recording sheet conveyance surface of the conveyance belt of the aforementioned first belt conveyance mechanism. The aforementioned second belt conveyance mechanism selects the passage of recording sheets together with the pinch roller using the changeover gate so that the recording sheets can be conveyed to the first bin or other bins including the second bin. The aforementioned second belt conveyance mechanism is disposed in such a manner that: the second belt conveyance mechanism can be rotated around one of the rollers; and the other roller is pressed against one of the rollers of the aforementioned first belt conveyance mechanism through the conveyance belts. At least one of the aforementioned pinch rollers is pressed against the aforementioned roller around which the second belt conveyance mechanism is rotated, through the aforementioned conveyance belt. Drive force can be transmitted to all portions of the sorter except for the changeover gates, from one of the aforementioned rollers which is driven.

The aforementioned second object can be accomplished by a sorter having a plurality of bins, changeover gates for the bins and a conveyance means for recording sheets, wherein the conveyance means is provided with an endless conveyance belt wound around at least a pair of rollers, and is provided with a plurality of pinch rollers. The aforementioned pinch rollers are disposed close to the aforementioned bins and changeover gates in such a manner that they are pressed against the recording sheet conveyance surface of the aforementioned conveyance belt. A guide member made of a cushion member upon which a low friction member is adhered, is fixed to the frame of the sorter in such a manner that the guide member is opposed to the region in which the aforementioned pinch rollers are disposed.

DETAILED DESCRIPTION OF THE PREFERRED EMBODIMENTS

Figure 1:
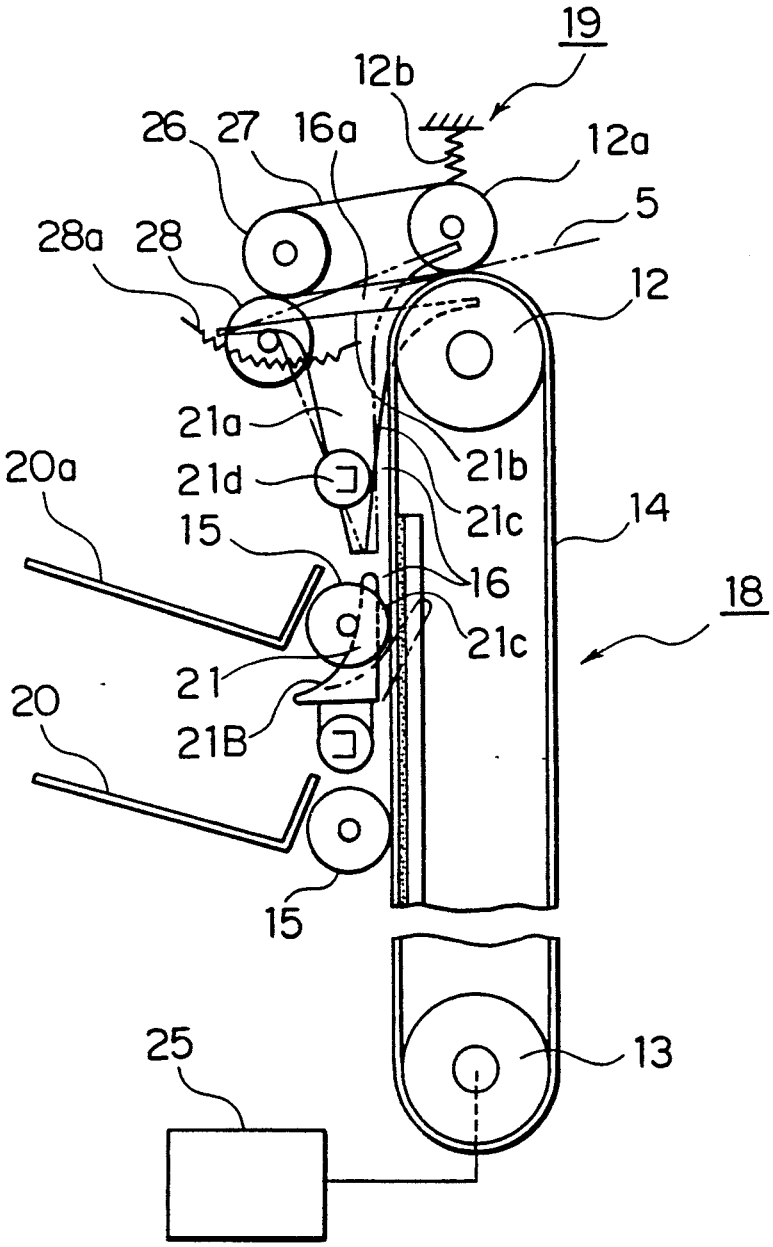
FIG. 1 is a side view showing the structure of the conveyance means of a sorter according to a first embodiment the present invention.
Figure 2:
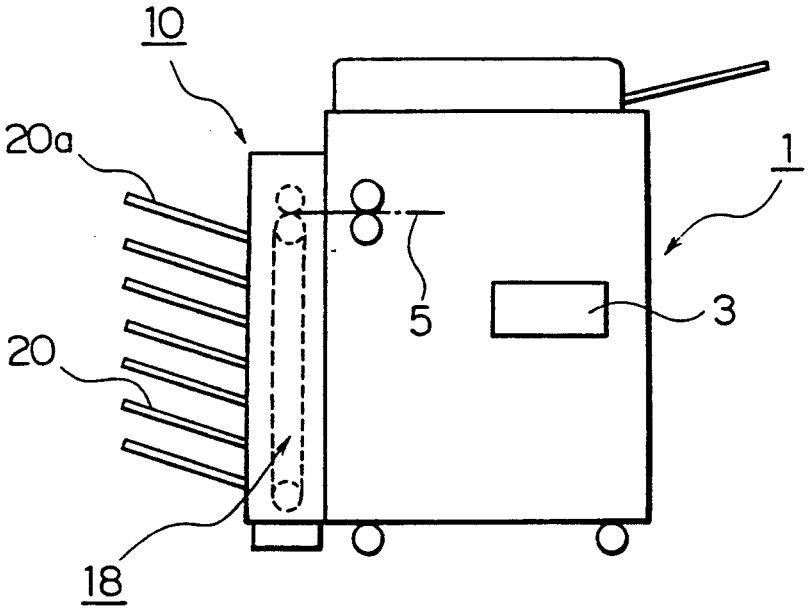
FIG. 2 is a schematic illustration showing the state in which an image forming apparatus and a sorter are combined.
Figure 3:
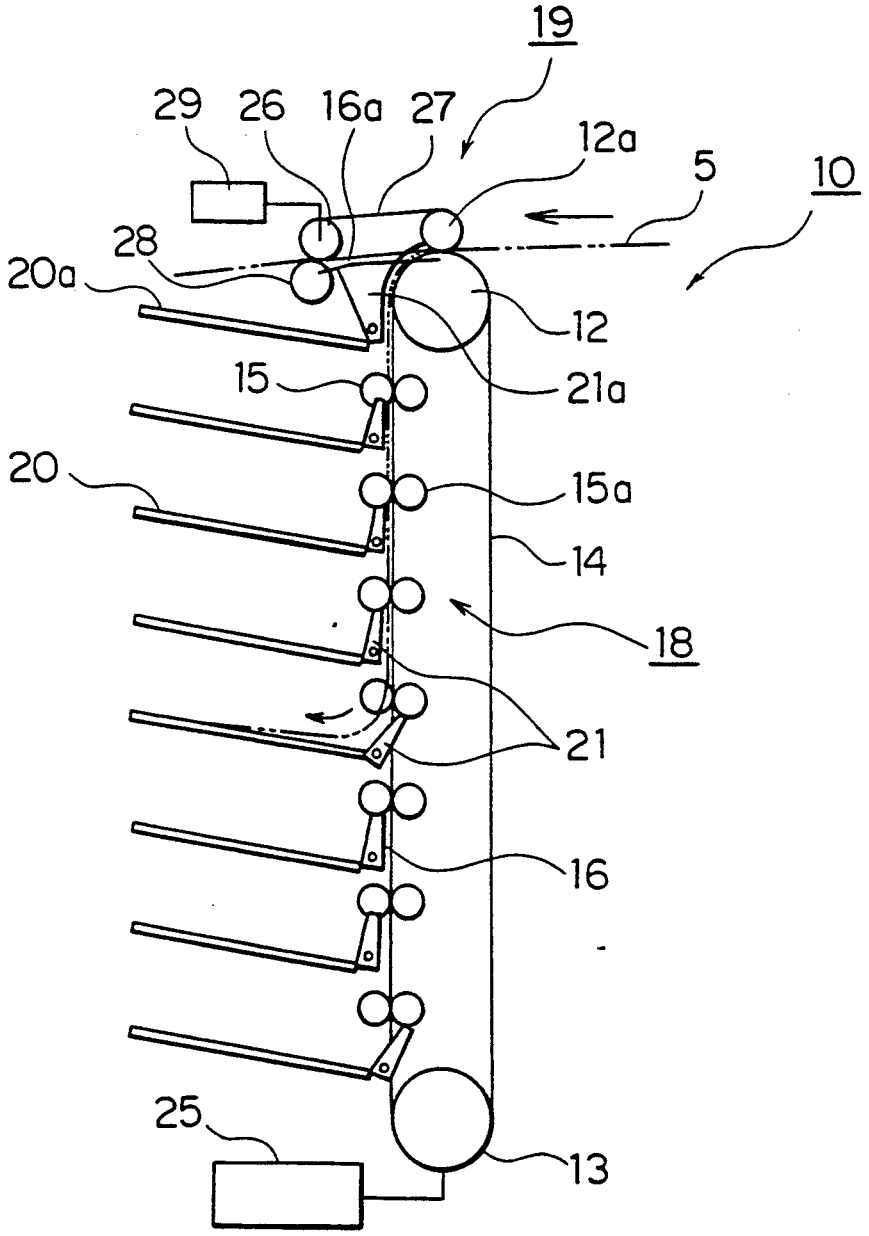
FIG. 3 is a side view showing the structure of a conventional conveyance means.

Referring now to FIG. 1 which is a side view showing the structure of the conveyance means of the sorter according to the present invention, the first embodiment will be explained as follows.

However, it should be understood that the present invention is not limited to the specific embodiment. Like parts in each of the several drawings are identified by the same reference character.

As shown in FIG. 1, the second belt conveyance mechanism 19 is installed above the first belt conveyance mechanism 18, and composed of rollers 12*a*, 26 and a plain belt 27 which is wound around the aforementioned rollers 12*a*, 26. A pinch roller 28 is pressed against the roller 26 through the plain belt 27. Between the first and second belt conveyance mechanism is provided a changeover gate 21*a* which changes over document sheets. The aforementioned second belt conveyance mechanism can be rotated around the roller 26. The aforementioned roller 12*a* is pressed against an upper roller 12 of the aforementioned first belt conveyance mechanism 18 with a predetermined force by a spring 12*b* through the aforementioned plain belt 27 and a conveyance belt 14. The aforementioned pinch roller 28 is provided below the aforementioned roller 26 in such a manner that the pinch roller 28 is pressed upward against the roller 26 with a predetermined force by a spring 28*a* through the plain belt 27.

The aforementioned gate 21*a* is provided among the aforementioned first and second belt conveyance mechanism and the pinch roller 28 in such a manner that the gate 21*a* can be rotated around a fulcrum 21*d*. The changeover gate 21*a* is provided with an upper conveyance surface 21*b* which forms a conveyance passage 16*a* together with the lower surface of the aforementioned plain belt 27, and a sorting conveyance surface 21*c* which forms a sorting conveyance passage 16 together with the conveyance belt 14. The aforementioned changeover gate 21*a* and the sorting gate 21 provided to each bin 20 are driven by a magnet of a cam installed in the aforementioned sorter 10 in order to open and close the aforementioned conveyance passages 16*a*, 16. In the aforementioned second belt conveyance mechanism 19, the drive unit to drive the aforementioned roller 26 and drive force transmitting mechanism which are exclusively provided in a conventional sorter, are not used, and the torque of the upper or lower roller 12 of the aforementioned first belt conveyance mechanism 18 is utilized in such a manner that the torque can be transmitted to the aforementioned roller 12*a* through the frictional force of the aforementioned recording sheet 5 discharged from the aforementioned image forming apparatus 1. The torque transmitted to the roller 12*a* in the manner described above, is further transmitted to the aforementioned roller 26 which is connected with the roller 12*a* through the aforementioned plain belt 27, and then the torque is further transmitted to the aforementioned pinch roller 28 through the plain belt 27. According to a command of non-sorting, the aforementioned changeover gate 21*a* is tilted to the right so as to close the aforementioned conveyance passage 16 formed between the changeover gate 21*a* and the conveyance belt 14, and the aforementioned conveyance passage 16*a* which is formed between the changeover gate 21*a* and the plain belt 27, can be opened, so that the recording sheet 5 is conveyed along the aforementioned upper conveyance surface 21*b* of the changeover gate 21*a* and the lower surface of the aforementioned plain belt 27, and then the recording sheet 5 is conveyed to the aforementioned first bin 20*a* by the aforementioned plain belt 27 and pinch roller 28.

According to the command of a sorting operation, the recording paper 5 is conveyed as follows. After the first recording paper 5 has been put into the first bin 20*a*, the aforementioned changeover gate 21*a* is tilted to the left so that the conveyance passage 16*a* to the first bin 20*a* is closed, and at the same time, the passage 16 for exclusive use in sorting operation is opened, and then the recording paper 5 is conveyed along the aforementioned conveyance belt 14 and the conveyance surface 21*c* of the aforementioned changeover gate 21, to a pinch roller 15 which is located below the aforementioned first bin 20*a* and rotated being pressed against the surface of the conveyance belt 14.

The recording paper 5 is pinched and conveyed by the conveyance belt 14 and the pinch roller 15, and put into the second bin 20 being conveyed along a conveyance surface 21*b* of the aforementioned changeover gate 21.

In the same manner, the n-th recording paper 5 is put into the n-th bin 20 by the pinch roller 15 and the changeover gate 21 which are provided corresponding to the n-th bin 20. The sorting operation of the first page is completed in the manner described above, and the sorting operation of the second page starts at the n-th bin and advances upward, and when the n-th recording paper is put into the aforementioned first bin 20*a*, the sorting operation of the second page is completed. The first recording paper of the third page is put into the aforementioned first bin 20*a* by the second belt conveyance mechanism 19, the pinch roller 28 and the changeover gate 21*a*, and then the second recording paper and the recording papers after the second are successively conveyed into predetermined bins 20 by the aforementioned first belt conveyance mechanism 18, the pinch roller 15 and the changeover gate 21 so that the recording papers 5 care sorted into a desired number of volumes.

In the case where a jam of the aforementioned recording paper 5 has occurred in the sorted described above, a rear cover (not shown in the drawing) which is composed integrally with the aforementioned first belt conveyance mechanism 18, is rotated to the right around the aforementioned lower conveyance roller 13, so that a wide space can be ensured between the first belt conveyance mechanism 18 and the second belt conveyance mechanism 19. Consequently, jam clearance can be very easily conducted.

A CPU provided in the aforementioned image forming apparatus 1 controls the rotation of the first belt conveyance mechanism 18 and the second belt conveyance mechanism 19, and the changeover operations of the changeover gates 21*a*, 21. In this embodiment, the driving unit 25 is connected with the roller 13. However, it should be understood that the driving unit 25 may be connected with any other rollers.

According to the present invention, the recording paper conveyance means of the first and second belt conveyance mechanism, the pinch rollers and the changeover gates are so simplified that the cost can be remarkably reduced, and further, even when a recording paper has jammed in the sorter, it can be easily removed from the apparatus.

Figure 4:
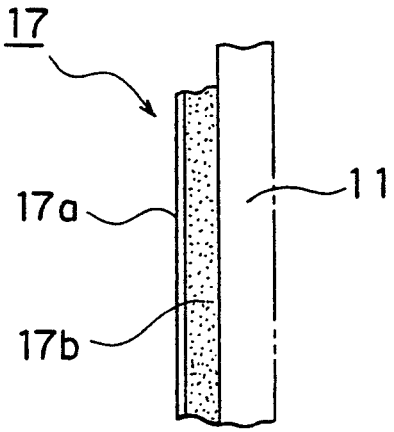
FIG. 4 is a side sectional view showing the structure of a guide member of the sorter of FIG. 6.

Referring now to FIG. 4 which is a side sectional view of a guide member, FIG. 5 which is a side view of sorting mechanism, and FIG. 6 which is a side sectional view of a sorter, the second embodiment of the present invention will be explained as follows.

However, it should be understood that the present invention is not limited to the specific embodiments. Like parts in each of the several views are identified by the same reference character.

Figure 6:
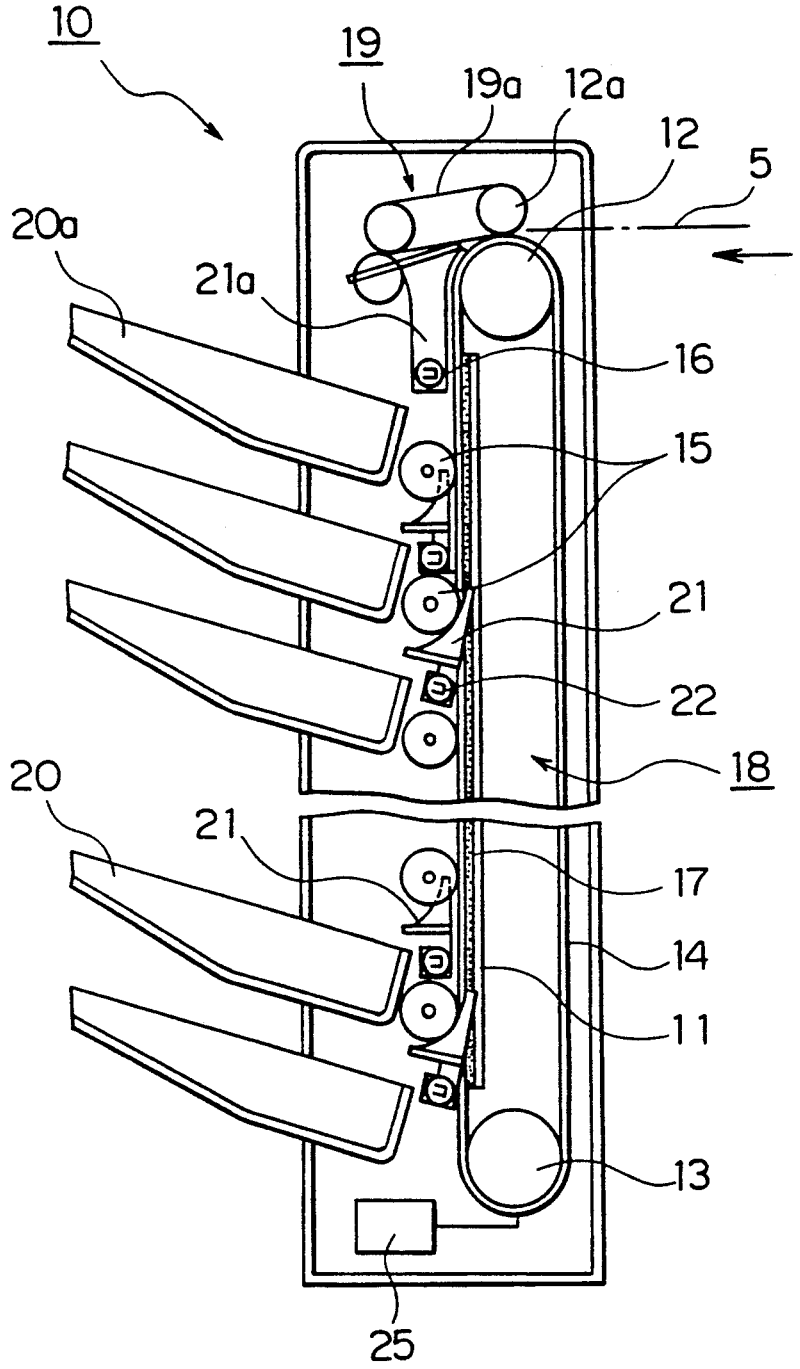
FIG. 6 is a side sectional view showing the structure of a sorter in accordance with a second embodiment of the present invention.

As illustrated in FIG. 6, the conveyance unit of the aforementioned sorter 10 is composed of: the second belt conveyance mechanism 19 which conveys a recording sheet 5 to the first bin 20*a*, wherein the first bin 20*a* is used not only in the case of a sorting operation but also in the case of a non-sorting operation; and the first belt conveyance mechanism 18 which sorts recording papers 5 into bins 20 including the first bin 20*a* using a changeover gate 21. As illustrated in the drawing, the aforementioned first belt conveyance mechanism 18 is composed of an upper roller 12 and a lower roller 13 which are vertically arranged being rotatably supported by side plates of the sorted 10, and an endless conveyance belt 14 is wound around the upper and lower rollers 12, 13.

The aforementioned lower roller 13 is driven by a drive unit 25 provided in the aforementioned sorter 10 so that the aforementioned conveyance belt 14 can be vertically rotated.

In order to solve the aforementioned problems, a guide member 17, the structure of which will be described as follows, is provided inside the aforementioned conveyance belt 14. As illustrated in FIG. 4, the aforementioned guide member 17 is composed of: a cushion member 17*b* which is made of a resilient material such as synthetic rubber, Moltplain as an example, the thickness of which is adequate; and a low friction member 17*a* which is made of a low friction material such as Teflon, wherein the low friction member 17*a* adheres to the cushion member 17*b*. The width of the aforementioned guide member 17 is approximately the same as that of the conveyance belt 14, and the length is appropriate.

The length of the aforementioned guide member 17 is determined so that it can cover the region in which all pinch rollers 15 are activated. The detail of the pinch rollers 15 will be described later.

As illustrated in FIG. 6, the aforementioned guide member 17 is installed in the sorter in such a manner that: the aforementioned low friction member 17*a* is in contact with the inside of the left straight portion of the aforementioned conveyance belt 14 (as shown in the drawing) and which is wound around the aforementioned upper roller 12 and lower roller 13; and the aforementioned cushion portion 17*b* is integrally fixed to a sorter frame 11.

Consequently, while the aforementioned conveyance belt 14 is running, it is always in contact with the surface of the aforementioned low friction member 17*b*.

The pinch roller 15 corresponding to each bin 20 is provided in such a manner that: the pinch roller 15 is pressed against the surface of the conveyance belt 14 with predetermined force, wherein the conveyance belt 14 is supported by the aforementioned guide member portion 17.

Accordingly, an appropriate dent portion is formed on the surface of the aforementioned conveyance belt 14 by the aforementioned pinch roller 15 due to the resilience of the aforementioned cushion member 17*b* of the guide member 17, so that the contact area of the pinch roller 15 and the conveyance belt 14 is increased, which is very advantageous from the viewpoint of recording paper conveyance.

Figure 5:
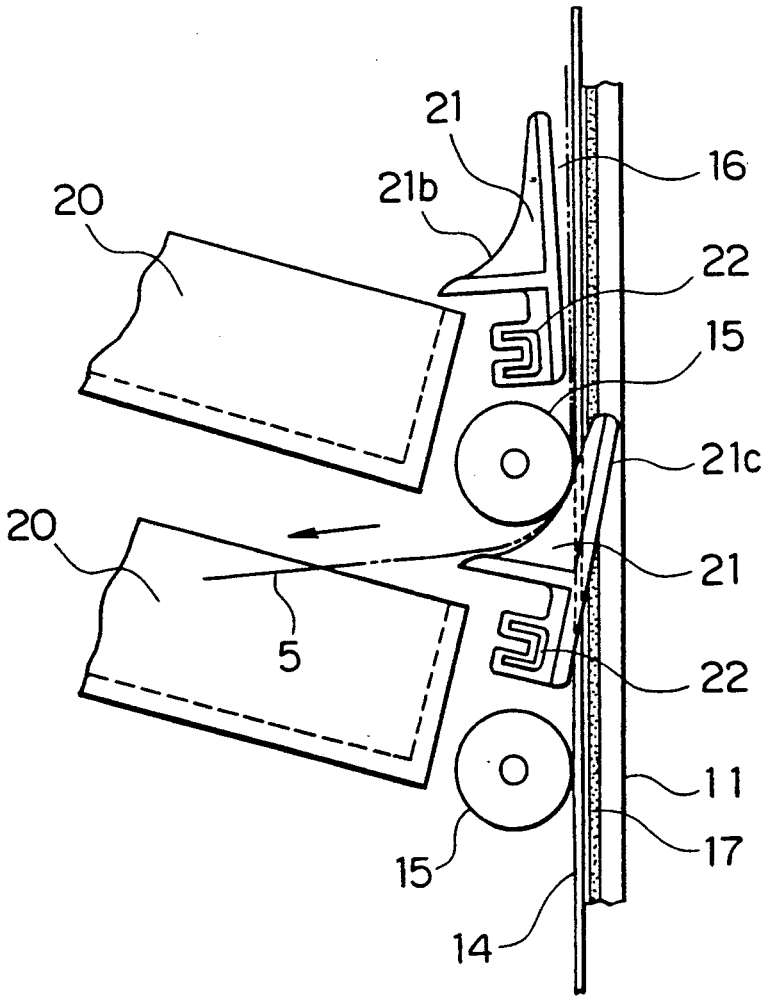
FIG. 5 is a fragmentary side view showing the sorter mechanism of FIG. 6.

As illustrated in FIG. 5 and FIG. 6, the gate member 21 is provided below the aforementioned pinch roller 15 in such a manner that the gate member 21 is located close to the pinch roller 15, wherein the gate member 21 is rotatably supported by the side plates of the sorter 10, and a conveyance passage 16 to convey the aforementioned recording sheet 5 is formed by the right side 21*c* of the gate member 21 and the surface of the conveyance belt 14. The aforementioned gate member 21 and aforementioned pinch roller 15 are disposed longitudinally with regard to the aforementioned sorter 10, corresponding to each bin 20. The recording paper 5 is conveyed to a predetermined bin 20 in such a manner that: the gate member 21 is tilted to right around a shaft 22 as viewed int he drawing so that the aforementioned conveyance passage 16 can be closed; and the recording paper 5 is conveyed along the left side 21*b* of the gate member 21.

The second belt conveyance mechanism 19 is provided in the upper portion of the first belt conveyance mechanism 18, and an idle roller 12*a* rotatably supported by the side plates of the sorter 12 is pressed against the upper conveyance roller 12 through the conveyance belts 14, 19*a* so that the rotation of the upper conveyance roller 12 can be transmitted to the idle roller 12*a*. In the case where it is not necessary to sort the recording papers 5, the recording papers 5 are conveyed through a conveyance passage formed by the gate 21*a* which is provided corresponding to the aforementioned second belt conveyance mechanism 19, and all the recording papers 5 are put into a bin 20*a* for non-sorting use which is located in the uppermost portion of the sorter 10.

Usually, the aforementioned bin 20*a* for non-sorting use is utilized not only in the case of a non-sorting operation but also in the case of a sorting operation. In the case of a sorting operation, the aforementioned gate member 21*a* is changed over so that the recording sheets 5 can be sequentially sorted into the first bin 20*a* to the n-th bin 20.

Next, the operation of the first belt conveyance mechanism 18 in the case of a sorting operation will be described as follows. The recording paper 5 is conveyed by the aforementioned upper conveyance roller 12 and idle roller 12*a*, and after the first recording paper 5 has been put into the first bin 20*a*, the aforementioned changeover gate 21*a* is tilted to the left so that the conveyance passage 16*a* to the first bin 20*a* is closed, and at the same time, the passage 16 for exclusive use in sorting operation is opened. Then, the aforementioned recording sheet 5 passes through the opened conveyance passage 16 and advances downward. The recording sheet 5 is further conveyed downward being pinched by the pinch roller 15 and the conveyance belt 14, and then the recording sheet 5 is conveyed along the left side surface of the gate member 21 to the second bin 20, wherein the gate member 21 closes the aforementioned conveyance passage 16.

In the manner described above, the following recording sheets 5 are successively sorted into the third to n-th bin 20 by the gate 21 so that a desired number of volumes can be obtained.

In the sorter according to the present invention, the aforementioned conveyance belt 14 is guided by the aforementioned guide member 17 instead of conventional guide rollers, so that the recording sheet can be positively conveyed without making a loud noise.

A CPU 3 provided in the aforementioned image forming apparatus 1 controls the rotation of the first belt conveyance mechanism 18 and the second belt conveyance mechanism 19, and the changeover operations of the changeover gates 21*a*, 21.

According to the present invention, instead of numerous guide rollers provided along the inside surface of the conveyance belt, the very simple guide member is provided to the sorter. Consequently, the cost can be greatly reduced, and the sorter can be driven without making a loud noise. Due to the cushion of the aforementioned guide member, the recording sheet sorting operation can be conducted more positively than the conventional sorter.

What is claimed is:

1. A sorter for sorting recording sheets after image recording by an image forming apparatus, comprising:

means having a plurality of bins arrayed parallel to a main path of the recording sheets for stacking the recording sheets;

branch gate means having a plurality of change-over gates, each change-over gate corresponding to a respective one of the bins, for selectively guiding each one of the recording sheets from the main path to a selected bin by change-over of the corresponding change-over gate; and conveyance means for conveying each recording sheet delivered from the image forming apparatus along the main path to the selected bin guided by the branch gate means, which comprises a first endless belt and a plurality of guide rollers located on a surface of the first endless belt near the change-over gates for pressing each recording sheet onto a surface of the endless belt, and a planar belt guide including a resilient portion, the planar belt guide supporting the first endless belt against the pressure from the guide rollers by contacting a rear surface of the first endless belt wherein the resilient portion comprises a cushion member of elastic material and a low friction member of low frictional material forming a surface of the resilient portion.

2. A sorter for sorting a recording sheet after recording by an image recording apparatus, comprising:

bin means having a plurality of bins arrayed parallel to a main path of the recording sheet in an order from a first bin to a last bin for receiving the recording sheet;

branch gate means having a plurality of change-over gates arrayed in like order to the array of bins, each change-over gate corresponding to a respective one of the bins, for selectively guiding the recording sheet from the main path to a selected one of bins by change-over of the corresponding change-over gate;

conveyance means for conveying the recording sheet along the main gate to the selected bin guided by the branch gate means, which comprises:

an endless belt and a plurality of guide rollers located on a surface of the endless belt near the change-over gates for pressing the recording sheet onto a surface of the endless belt, a guide member supporting the endless belt against pressure from the guide rollers by contacting a rear surface of the endless belt, said guide member including a cushion member being of an elastic material and a low friction member of a low frictional material forming a surface over the elastic material.

3. The sorter of claim 2, wherein the conveyance means further comprises:

a conveyance mechanism having a pair of conveyor rollers and a second endless belt stretched between the pair of conveyor rollers for selectively carrying each recording sheet, guided by a first gate, to either of a first one of the bins or one of the change-over gates, the conveyance mechanism being rotatable around the center of one conveyor roller of the pair of conveyor rollers;

whereby all of the pair of conveyor rollers and the plurality of guide rollers in the conveyance means can be rotated by driving one of the pair of conveyor rollers.

* * * * *